United States Patent [19]

Pytryga et al.

[11] Patent Number: 4,802,515

[45] Date of Patent: Feb. 7, 1989

[54] SAFETY GAS CYLINDER CONTAINMENT SYSTEM

[76] Inventors: Frank G. Pytryga, 972 Arundel Dr., Arnold, Md. 21012; Martin Prince, 58 Darlington Dr., Wayne, N.J. 07470

[21] Appl. No.: 933,160

[22] Filed: Nov. 21, 1986

[51] Int. Cl.[4] ..... B65B 21/00

[52] U.S. Cl. ..... 141/97; 220/3; 220/411; 414/745.2

[58] Field of Search ..... 141/1, 4, 97; 109/49.5; 206/3, 521, 583, 591, 592; 220/3, 411, 412; 414/289, 403, 745

[56] References Cited

U.S. PATENT DOCUMENTS

| | | | |
|---|---|---|---|
| 552,014 | 12/1895 | Thompson | 254/264 |
| 1,026,465 | 5/1912 | Scholz | 414/419 X |
| 3,136,413 | 6/1964 | Hall | 206/583 X |
| 3,166,978 | 1/1965 | Price et al. | 206/3 X |
| 3,368,452 | 2/1968 | Fredrickson et al. | 206/3 X |
| 3,974,846 | 8/1976 | Serota | 137/318 X |
| 4,354,608 | 10/1982 | Wudtke | 254/264 X |
| 4,538,659 | 9/1985 | Adelman et al. | 141/97 |
| 4,603,432 | 7/1986 | Marino | 383/2 |
| 4,629,157 | 12/1986 | Tsuchiya et al. | 251/96 |

FOREIGN PATENT DOCUMENTS

| | | | |
|---|---|---|---|
| 57181 | of 1891 | Fed. Rep. of Germany | 206/3 |

*Primary Examiner*—Werner H. Schroeder

*Attorney, Agent, or Firm*—Foley & Lardner, Schwartz, Jeffery, Schwaab, Mack, Blumenthal & Evans

[57] ABSTRACT

A safety gas and liquid containment unit is provided with sealing for retaining the hazardous gas therein until treated. The containment unit can be placed on a transport carrier and rotated from a vertical position to a horizontal position thereon. The gas cylinder may be brought to the containment unit by placing it on a wheeled cart. By aligning the cart with the horizontally positioned containment unit, the container is then transferred from the cart to the containment unit, which can in turn be transported to an appropriate area for treatment. Upon removal of the toxic or other gases, the container can be withdrawn from the containment unit by a winch mechanism.

14 Claims, 6 Drawing Sheets

SAFETY GAS CYLINDER CONTAINMENT SYSTEM

BACKGROUND OF THE INVENTION

1. Field of the Invention

The invention relates to the method of containing gas or liquid cylinders in a safety environment, together with the apparatus therefor.

2. Related Art

There are many types of gas cylinders which contain toxic and other hazardous gases or liquids. Through improper handling or by accident, the gas in the cylinders may begin to leak. This often occurs at the valve or valve stem. It is then incumbent upon the appropriate personnel to either stop the leak or to remove the container to a remote area for treatment of the toxic gas.

An emergency team normally comprises several individuals who obviously need breathing apparatus. While the emergency team is on the premises, personnel in the laboratory, storage area, transportation area or the like either have to be evacuated or must utilize the same or similar breathing apparatus. This ofen creates a hazardous condition for a large number of employees, bystanders or other third parties who must be evacuated from the premises for a considerable period of time while the cylinder is either being repaired or the gases depleted such as by placing the container in a control cabinet.

Often, there is no control cabinet at the particular location of the leak; therefore, it is necessary for the emergency team to move the container to another location. This obviously creates a dangerous situation, not only at the initial location, but also along the way to the containment area. Thus, a large number of individuals may be endangered, as well as entire facilities being evacuated and shut down for a considerable period of time.

OBJECTS AND SUMMARY OF THE INVENTION

It is therefore a prime object of the invention to provide a method and apparatus for containing a leaking cylinder by a minimum number of emergency personnel.

Another object of the invention is to provide a sturdy cylinder storage container which can accommodate cylinders of varying size.

Still another object of the invention is to provide a cylinder container which has means for easily removing the depleted cylinder therefrom.

Another object of the invention is to provide a method and apparatus for quickly and easily moving cylinders of various sizes within the emergency container from the site of the leak by a minimum number of individuals.

By use of the present invention, it is no longer necessary to move the leaking cylinder to a control cabinet since the unit can be used for pretreatment through valves thereon, or the treatment mechanism may be connected directly to the containment unit, thus making the unit a control cabinet itself.

Because of the design of the containment system, it will support a rupture, as well as make it possible to open or close a valve (assuming operability of the valve) while the cylinder remains in the containment unit.

The transport system associated with the containment unit cannot only be moved from place to place in a facility by rolling, but may easily be transported by vehicle from the initial location to a safer place away from employees or other individuals.

A safety gas containment unit is provided with sealing means for retaining the hazardous gas therein until treated. The containment unit can be placed on a transport carrier and rotated from a vertical position to a horizontal position thereon. The gas cylinder may be brought to the containment unit by placing it on a wheeled cart. By aligning the cart with the horizontally positioned containment unit, the container is then transferred from the cart to the containment unit, which can in turn be transported to an appropriate area for treatment. Upon removal of the toxic or other gases, the container can be withdrawn from the containment unit by a winch mechanism.

BRIEF DESCRIPTION OF THE DRAWINGS

The above and other objects and advantages of the invention will be better appreciated from the following description and enclosed drawings wherein.

DETAILED DESCRIPTION OF THE INVENTION

The invention includes three basic elements and associated methods, namely the containment device per se, the transport system and the cylinder withdrawal system.

Containment Unit

Figure 3:
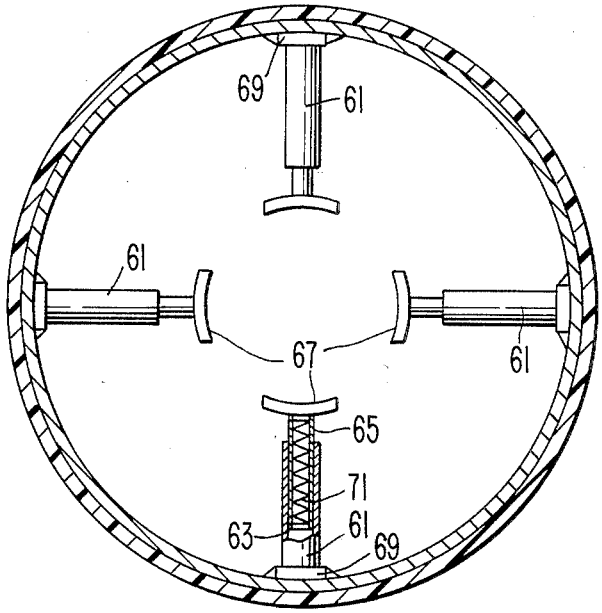
FIG. 3 is a cross-sectional view taken along lines 3—3 in FIG. 1.
Figure 4:
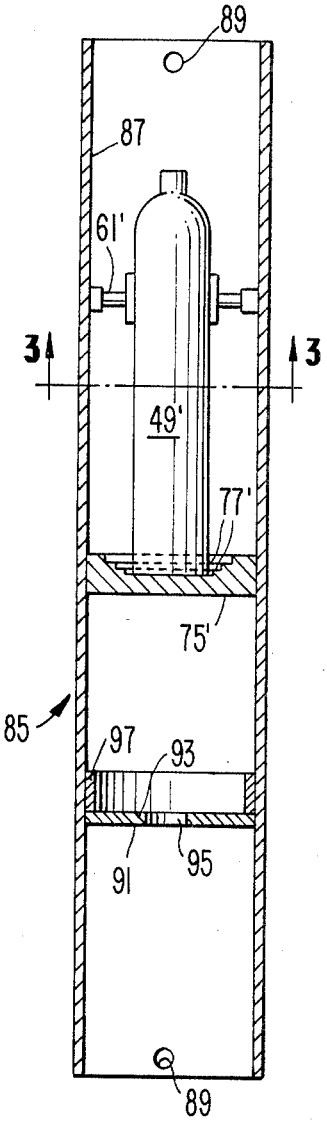
FIG. 4 is an insert for the containment unit.
Figure 5:
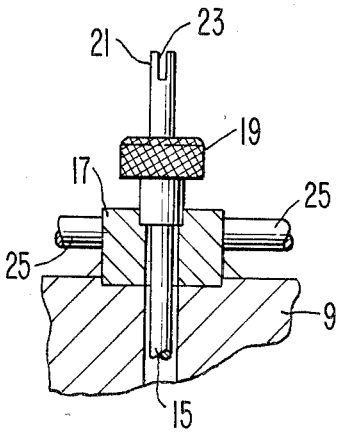
FIG. 5 is a detail of the valve actuator of Detail 5 in FIG. 1.

Referring first to FIGS. 1–5, a storage container is seen generally at 1. The container can be of various known materials and compositions; however, a preferred embodiment has an inner stainless steel liner which is wrapped with fiberglass or other filament wound material. The material of the liner and the wrapping, as well as the dimensions thereof, are determined by the pressure requirements and chemical resistance in a given situation. One form of liner and wrapping is illustrated in U.S. Pat. No. 3,969,812 which is hereby incorporated by reference. The cylinder 1 has a substantially hemispherical shaped top dome head 3 and is attached to an O-ring sealed access port 5, including an O-ring 7. A top access cover flange 9 includes an additional O-ring seal 11. The cover flange 9 includes a valve actuator cup 13. Attached to the cup 13 is a rod 15 which passes through the cover flange 9 and a block 17 as best seen in the detail of FIG. 5. Attached to the end of rod 15 is a modified rotary seal quick coupling 19. A bayonet lock 21 on rod 15 can accommodate a handle connected at 23 to rotate the rod 15.

Figure 2:
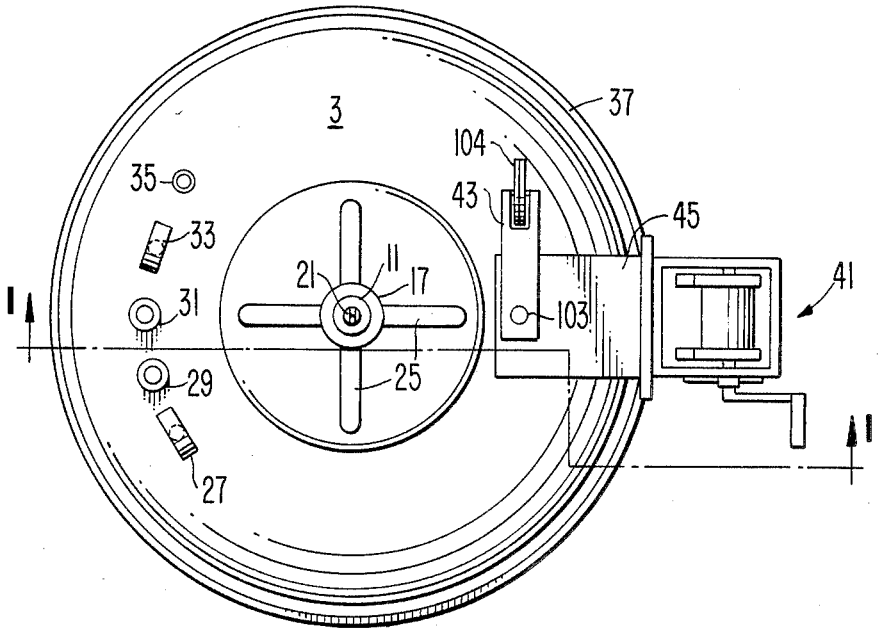
FIG. 2 is a top view of the containment unit.

As seen in FIG. 2 a plurality of handles 25 are used for rotating the top cover flange 9 which seals and unseals the flange from the access port.

The cover 3 as also seen in FIG. 2 includes various access ports and other openings which for example include a gas pressure gauge 27, a gas valve 29, a vacuum valve 31, a vacuum gauge 33 and an access port 35.

Figure 1:
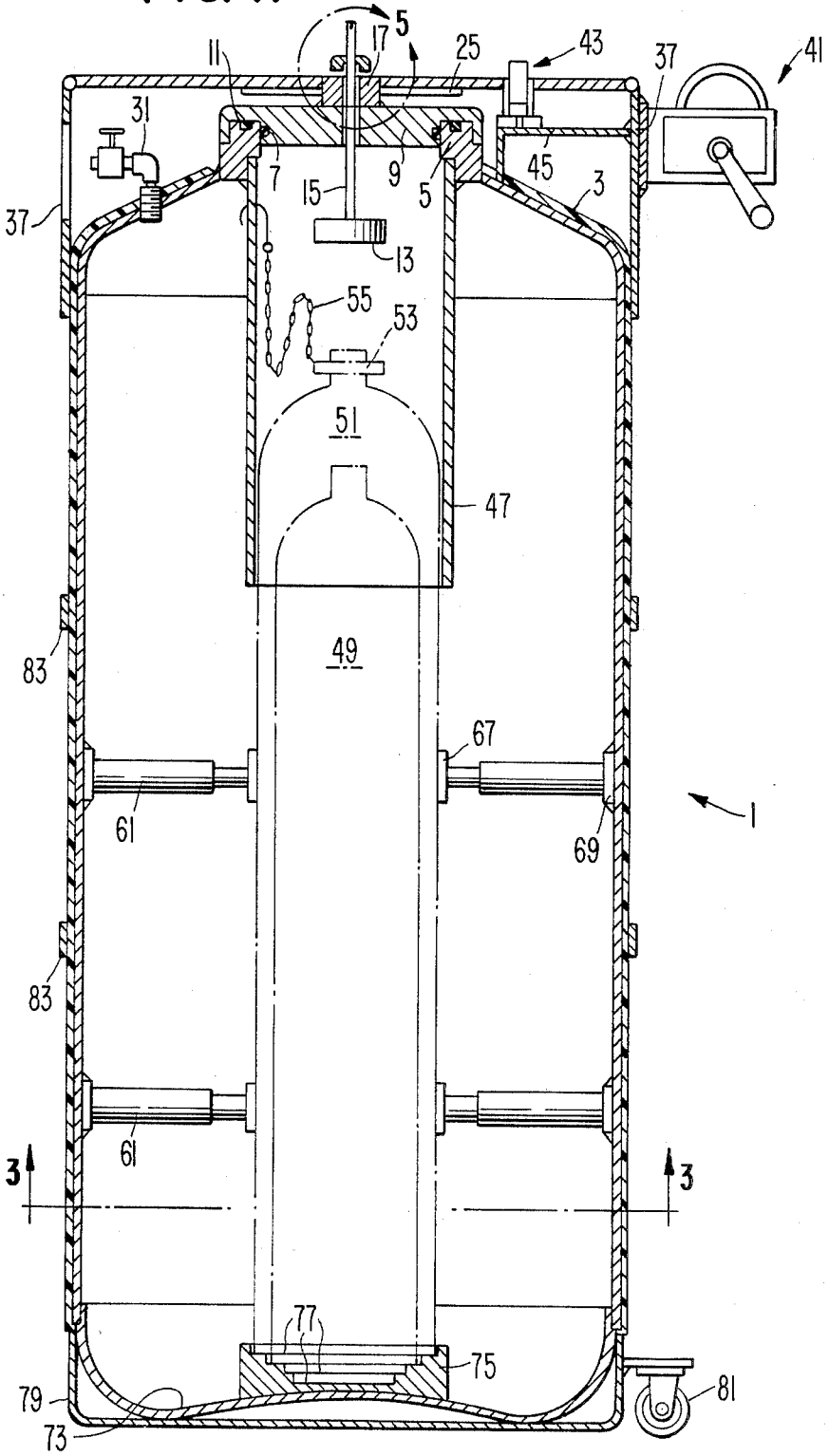
FIG. 1 is a schematic, cross-sectional view of the containment unit taken along lines 1—1 in FIG. 2.

A collar 37 which may be made of stainless steel is positioned on the cover 3 as seen in FIGS. 1 and 2. The collar 37 also supports a winch mechanism 41 (discussed below), as well as an outrigger 43 connected to a support plate by means of an outrigger support 45.

Suspended from the access port O-ring flange 5 is a guide cylinder tube 47. Positioned within the unit 1 and coaxial with the tube 47 are hazardous gas containers seen as cylinders 49 and 51 of two different sizes. The two cylinders are shown merely for illustration purposes, 49 being the smaller of the two. A ring attachment 53 is seen connected to the tube 47 via a cable 55, the cylinder collar or ring 53 and cable 55, as will be seen below, provide the means for withdrawing the cylinder (such as 49 and 51) from the unit 1 by means of the winch 41.

Referring to FIG. 3, together with FIG. 1, a plurality of spring loaded star rings 61 are used to center the cylinder within the unit. The star rings 61 each include an outer housing 63 and a piston member 65 to which a cylinder pad 67 is attached. The housing 63 is attached to the unit 1 by means a base pad 69. As seen in FIG. 3 a spring 71 provides the biasing means for the cylinder pads 67.

Referring back to FIG. 1, a bottom 73, either hemispherically shaped or shaped as seen in FIG. 1, is attached to cylindrical unit 1 to complete the enclosure. The base 73 includes a bottom cylinder seat flange 75 positioned axially on the base 73. The seat flange includes a plurality of concentric seats 77 which support various sized cylinders such as cylinders 49 or 51 schematically seen in FIG. 1. A removable dolly generally seen at 79 is attached to the base and includes a plurality of casters 81 for the purpose seen below.

During the wrapping of the unit 1, a plurality of annular locator means 83 are built in or formed thereon for positioning the unit during transportation as will also be discussed below.

Referring to FIG. 4, an insert tube for small cylinders is seen generally at 85. The insert includes a cylinder 87 with a bottom cylinder seat flange 75' with seats 77' formed similar to that seen in FIG. 1. A plurality of star support rings 61' support a smaller cylinder 49' in the same manner as seen in FIG. 1. A plurality of withdrawal holes 89 are seen at the top and the bottom of the cylinder tube. The holes are for the purpose of withdrawing the insert and cylinder from the unit in the same manner as the larger cylinders are withdrawn in FIGS. 1 and 6. The insert tube 85 as seen in the position shown in FIG. 4 is designed to accommodate smaller cylinders 49', the entire unit being positioned within tube 47 in FIG. 1. However, if odd shaped containers such as spheres or other materials are to be evacuated, the insert tube 85 is inverted and the object to be removed will rest on surface 91 of a support 93 which may include an opening 95 therethrough. In other words, a lecture bottle, sphere or other odd shaped member can be supported on 91, and in order to provide the necessary support for the support ring 91, an additional brace 97 is provided.

Cylinder Withdrawal System

Figure 6:
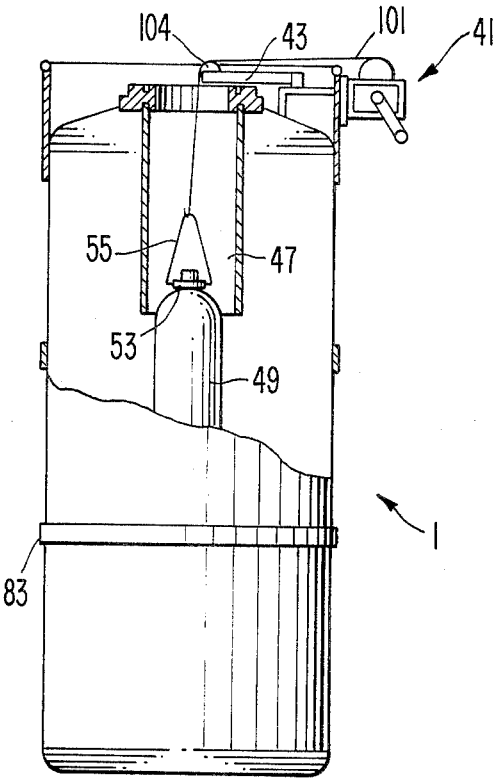
FIG. 6 is a schematic of the cylinder withdrawal mechanism.

Referring primarily to FIG. 6, a cylinder such as 49 is seen positioned schematically in the unit 1. The conventional winch mechanism 41 is connected via a wire or the like 101 to the cylinder cable withdrawal chain 55 attached to collar 53. Referring also to FIG. 2, the outrigger 43 is pivoted at point 103 and includes a pulley 104. With the outrigger 43 rotated counterclockwise 90 degrees, the mechanism appears as seen schematically in FIG. 6. Thus, after the cylinder 49 is placed in the unit 1, the collar 53 is attached thereto and the outrigger 43 is rotated to the position seen in FIG. 6, the cable 101 is attached to chain 55 and the cylinder can be withdrawn at the appropriate time and place. This will be put into prospective below. As will also be appreciated below, the withdrawal can take place in a horizontal position, as well as vertical.

Transport Carrier System

Figure 7:
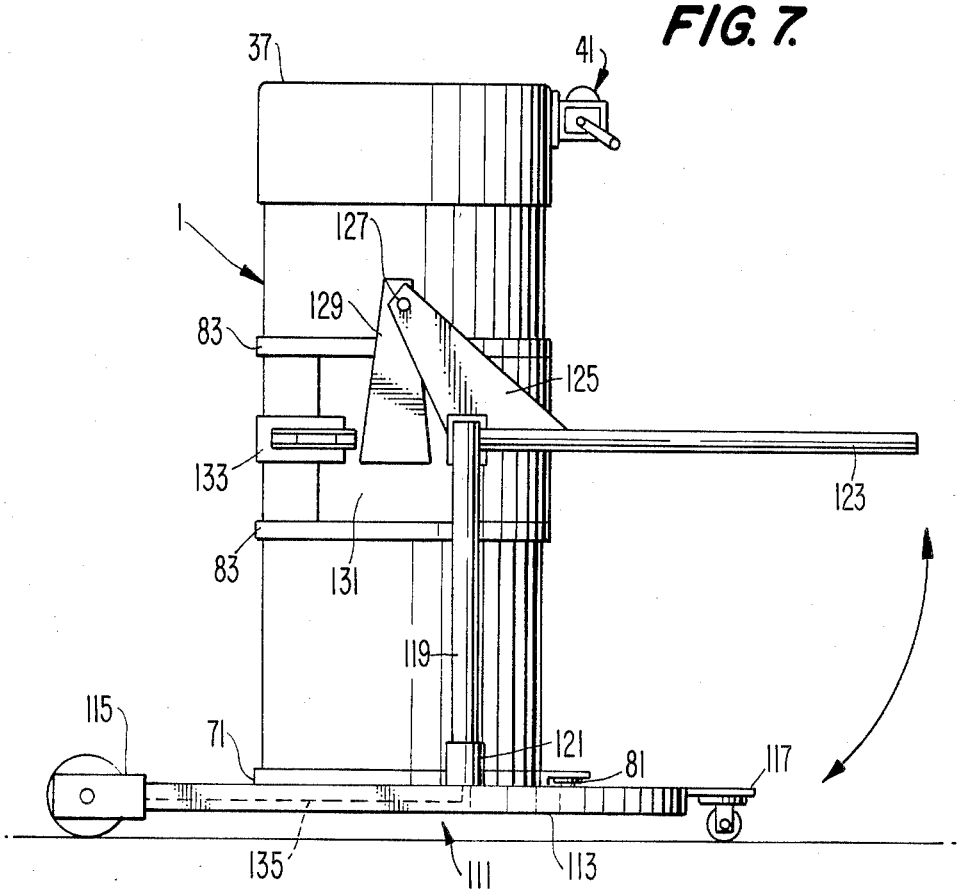
FIG. 7 is a side elevational view of the containment unit on a transport carrier.
Figure 8:
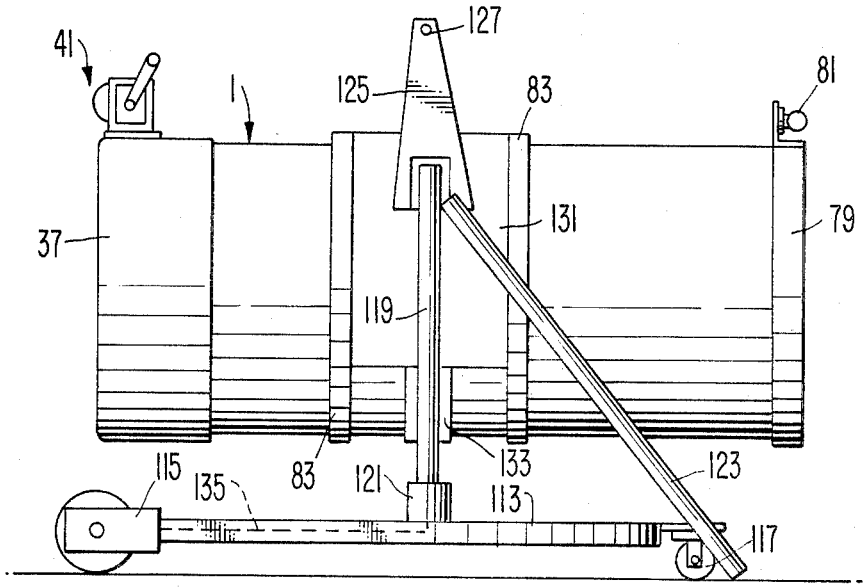
FIG. 8 is a side elevational view of the transport carrier of FIG. 7 with the containment unit rotated 90 degrees.
Figure 9:
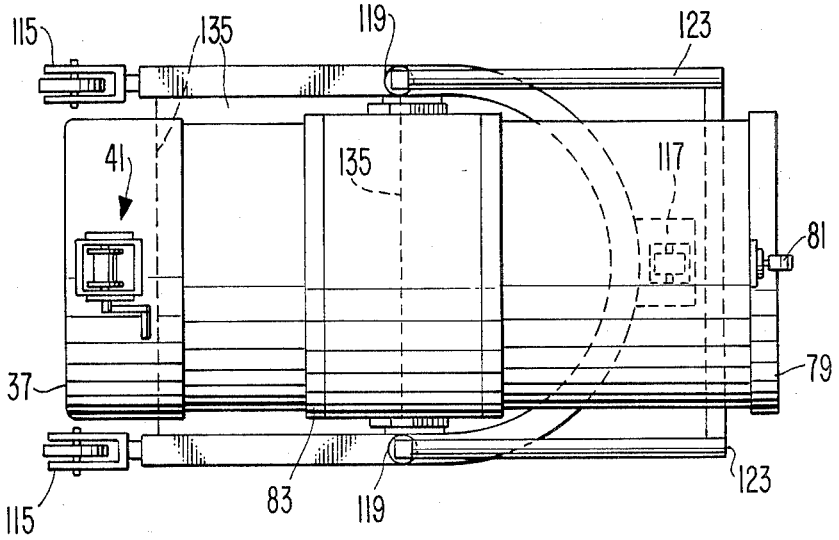
FIG. 9 is a top plan view of the carrier of FIGS. 8 and 9.

Referring to FIGS. 7 and 8, the emergency containment unit 1 is seen positioned on a transport carrier unit 111 which includes a base 113 supported at one end by a pair of casters 115 and at the other end by an outrigger caster and brake 117. A pair of vertical support members 119 are retained in a housing 121 on the base support 113. A containment support tilt locking assembly is positioned at the upper end of members 119 and includes a pair of handle and support stand members 123 which rotate about the upper end of member 119 at a pivot (not shown). Rigidly secured to the handle and support stand 123 is a tilt locking plate 125 which is pivoted at 127 to a permanent locking plate 129. (FIG. 7). Permanent locking plate 129 is affixed to a band 131 which encircles the containment unit 1 and has a conventional pivoted band lock 133. The pivoted band lock 133 is supported between the annular ring members 83.

As seen in dotted lines, an adjustable containment loading platform 135 is removably positioned on the base support 113, whereby the containment unit can be detached from the transport carrier while remaining on the adjustable loading platform.

As seen in FIG. 7, the containment unit is in the vertical position and the handle and support stand members 123 extend horizontally. When it is desired to load a cylinder into the containment unit, the handles are pivoted to the position seen in FIG. 8, thus rotating the containment unit to a horizontal position while the handle members 123 act as additional support for the transport carrier.

Cylinder Loading Cart

Figure 10:
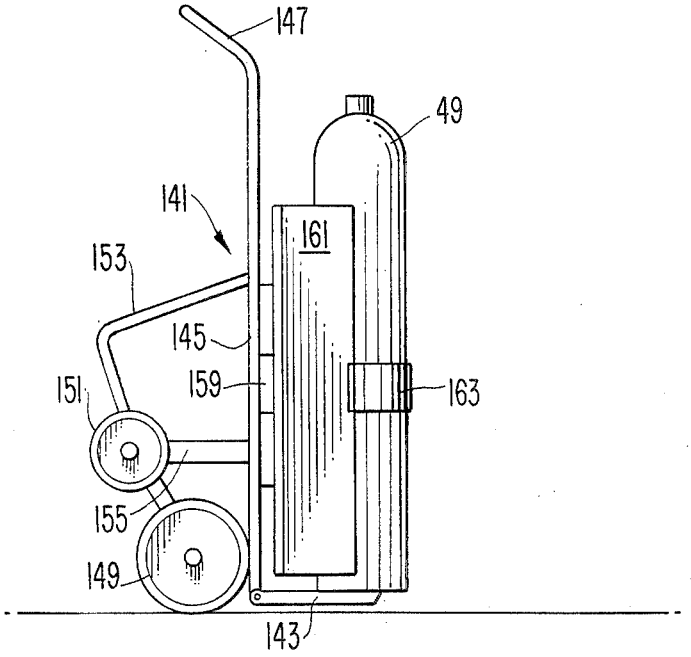
FIG. 10 is a side elevational view of a cylinder loading cart.
Figure 11:
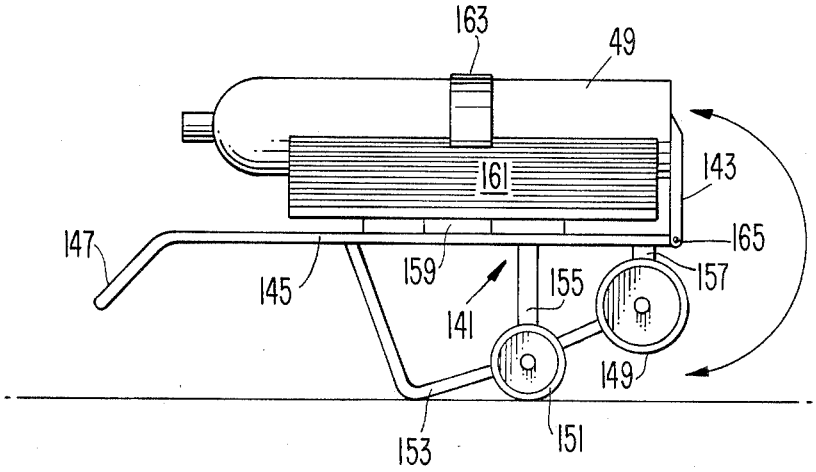
FIG. 11 is a side elevational view of the cylinder loading cart of FIG. 10 rotated 90 degrees.
Figure 12:
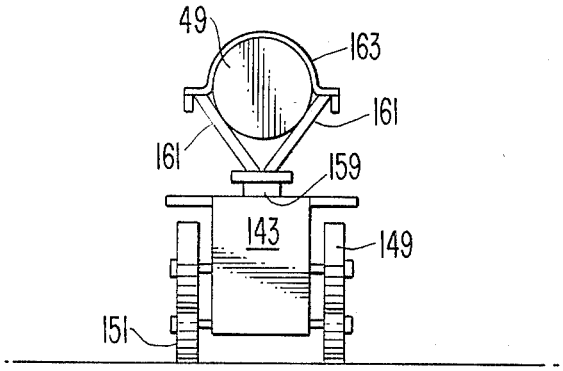
FIG. 12 is an end elevational view of the cylinder loading cart in the position shown in FIG. 11.

Referring next to FIGS. 10–12, the container which will be considered as container 49 from FIG. 1 is loaded onto the cart generally referred to as 141. Cart 141 includes a platform 143 seen in the horizontal position in FIG. 10. A second support platform 145 is attached to platform 143 and seen in the vertical position in FIG. 10 and further includes handle means 147. Attached to support 145 are a pair of large wheels 149 and a pair of smaller wheels 151 supported on a framework 153. The framework 153 includes a pair of conventional additional supporting members 155 and 157.

A vertically adjustable member 159 is attached to support 145 and has a V-block support in the form of members 161 mounted thereon. A conventional locking band 163 secures the cylinder 49 to the V-support members 161. As will be discussed below, platform 143 which is seen in the horizontal position in FIG. 10 and the vertical and upright position in FIG. 11, can pivot downward about a point 165 to a position shown in FIG. 12 to permit the cylinder 43 to slide longitudinally (FIGS. 11 and 12).

Operation

Briefly stated, the method of handling a defective container 49 consists of placing the cylinder on the loading cart as seen in FIG. 10. The cylinder is strapped onto the V-support block to prevent movement thereof. The cylinder loading cart 141 is then pivoted to a position midway between that seen in FIGS. 10 and 11 so that both pairs of wheels 149 and 150 engage the ground. The cylinder on the loading cart is then moved to the transport carrier which is in the position seen in FIG. 8. When the cylinder loading cart reaches the carrier, it is rotated on wheels 151 to the position seen in FIG. 11. The platform 143 is then pivoted downward to the position seen in FIG. 12. The strap 163 is removed and the cylinder is loaded into the transport carrier which is then rotated to the position seen in FIG. 7. The transport carrier is next moved to a safe area, and the containment unit 1 can be removed from the transport carrier by opening the pivoted band lock 133 and removing band 131 from the containment unit and by dropping the adjustment loading platform to free the containment unit from the platform.

If it is desired to withdraw the cylinder from the containment unit, this can be done as seen in FIG. 6 by attaching the cable 101 to chain 55 and ring 53. The cylinder is then withdrawn by means winch 41. This can be done while the containment unit is either in a horizontal or vertical position.

The contents from the container can be treated either in a control unit or in the containment unit itself. Such "treatment" includes "pretreatment," e.g., flooding the containment unit to maintain an inert atmosphere.

While several embodiments of the invention have been described, it will be understood that it is capable of still further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A gas containment unit comprising:

(a) a sealed storage means for receiving a container having hazardous gases or the like therein;

(b) said storage means having a bottom and a side wall;

(c) means for supporting the container in said storage means, said supporting means comprising:

(1) at least one seat flange positioned in said bottom; and (2) a plurality of means extending from said side wall and directed inwardly to support the gas container;

(d) means for gaining access at an end of said storage means;

(e) a vacuum valve for removing gas from said storage means; and (f) a gas valve for treating the gas in said storage means.

2. The unit of claim 1 including a valve actuator cup extending through said access means.

3. The unit of claim 1 wherein said means for removing the container includes a winch extending through said access means.

4. The unit of claim 3 including a ring attachment and chain connectable to said winch.

5. The unit of claim 1 wherein said supporting means includes a plurality of spring loaded means for centering the container.

6. The unit of claim 1, wherein said seat flange includes a plurality of concentric seats for supporting various sized gas containers.

7. The unit of claim 1 wherein said insert means includes withdrawal means at two ends and means for positioning said insert means in said storage means in two positions.

8. The unit of claim 1 including means for moving said storage means by rolling.

9. The unit of claim 1 including locator rings on the exterior of said storage means.

10. The unit of claim 1 including means for transporting said storage means.

11. The unit of claim 10 including means for suporting the storage means on said transporting means.

12. The unit of claim 11 wherein said storage supporting means includes means for retaining said storage means in a substantially vertical position and means for rotating said storage means to a substantially horizontal position.

13. The unit of claim 12 including a tilt locking assembly means having a pair of handle and support stand means for moving the transport means in one position and supporting it in another position.

14. The unit of claim 1 wherein said storage means comprises an inner stainless steel liner wrapped with filament wound material.

* * * * *